US009046802B2

(12) United States Patent
Yoshida et al.

(10) Patent No.: US 9,046,802 B2
(45) Date of Patent: Jun. 2, 2015

(54) LIQUID DEVELOPER CONTAINING ELECTRO-CONDUCTIVE PARTICLES AND AN ELECTRO-CONDUCTIVE PATTERN FORMING METHOD USING SAID MATERIAL AND AN ELECTRO-CONDUCTIVE PATTERN FORMING APPARATUS USING SAID MATERIAL

(71) Applicant: AFIT Corporation, Tokyo (JP)

(72) Inventors: Ichiro Yoshida, Tokyo (JP); Shuji Iino, Tokyo (JP)

(73) Assignee: AFIT Corporation, Tokyo (JP)

( * ) Notice: Subject to any disclaimer, the term of this patent is extended or adjusted under 35 U.S.C. 154(b) by 0 days.

(21) Appl. No.: 14/092,866

(22) Filed: Nov. 27, 2013

(65) Prior Publication Data

US 2014/0363764 A1 Dec. 11, 2014

(30) Foreign Application Priority Data

Jun. 11, 2013 (JP) ..... 2013-122583

(51) Int. Cl.

| | |
|---|---|
| ***G03G 9/093*** | (2006.01) |
| ***G03G 9/12*** | (2006.01) |
| ***G03G 15/10*** | (2006.01) |

(52) U.S. Cl.

CPC . *G03G 9/12* (2013.01); *G03G 15/10* (2013.01)

(58) Field of Classification Search

CPC ..... G03G 9/0821; G03G 9/08797; G03G 9/0819; G03G 9/12; G03G 13/10; G03G 9/132; G03G 15/0896; G03G 2221/163; G03G 21/16

USPC ..... 430/114, 117.5; 399/119

See application file for complete search history.

(56) References Cited

U.S. PATENT DOCUMENTS

| | | | |
|---|---|---|---|
| 4,892,798 | A | 1/1990 | Lamanna et al. |
| 4,985,321 | A | 1/1991 | Chou et al. |
| 5,066,560 | A | 11/1991 | Tan et al. |
| 5,089,362 | A | 2/1992 | Chou et al. |
| 5,424,129 | A | 6/1995 | Lewis et al. |
| 6,153,348 | A | 11/2000 | Kydd et al. |
| 6,251,555 | B1 | 6/2001 | Hayashi et al. |
| 6,979,523 | B1 | 12/2005 | Landa et al. |
| 8,053,073 | B2 | 11/2011 | Ueda et al. |
| 8,383,014 | B2 | 2/2013 | Vanheusden et al. |

(Continued)

FOREIGN PATENT DOCUMENTS

| | | | | |
|---|---|---|---|---|
| JP | 2004048030 | A | 2/2004 | |
| JP | 2004184598 | A | 7/2004 | |
| JP | 2005181621 | * | 7/2005 | ..... G03G 9/09 |
| JP | 2005181621 | A | 7/2005 | |
| JP | 2007206199 | A | 8/2007 | |

(Continued)

OTHER PUBLICATIONS

Machine English language translation of JP2005181621, Jul. 7, 2005.*

*Primary Examiner* — Hoa V Le

(74) *Attorney, Agent, or Firm* — Tungsten IP; Curtis Droege

(57) ABSTRACT

A novel liquid toner development system is disclosed. The liquid development system includes conductive core-shell particles comprising silver-copper or copper-silver. A novel apparatus and method relying on the novel liquid toner development system results in electro-conductive patterning capable of high conductivity with low background fogging, reduced processing time and reduced environmental impact.

8 Claims, 6 Drawing Sheets

(56) References Cited

U.S. PATENT DOCUMENTS

| | | | |
|---|---|---|---|
| 2005/0227158 | A1 | 10/2005 | Yamauchi et al. |
| 2007/0264502 | A1 | 11/2007 | Floess et al. |

FOREIGN PATENT DOCUMENTS

| | | | |
|---|---|---|---|
| JP | 2007206571 | A | 8/2007 |
| JP | 2013041195 | A | 8/2011 |

* cited by examiner

| | Particle | | | Charge Control Agent | | Characteristics | | |
|---|---|---|---|---|---|---|---|---|
| | Type | Plating | Ag Dia. | C Ctrl | C Ctrl | Thick | V Res | BF |
| | | [wt%] | [μm] | Agent | [wt%] | [μm] | [Ωcm] | Rank |
| Op. Ex. 1 | Cu-Ag | 0.12 | 1 | G: V-220 | 7 | 5 | 4.0 x 10-5 | 5 |
| Comp. Ex. 1 | Ag | 0 | 1 | G: V-220 | 7 | 1 | > 1.0 x 10-1 | 1 |
| Op. Ex. 3 | Cu-Ag | 0.012 | 1 | G: V-220 | 7 | 4.1 | 3.3 x 10-5 | 3 |
| Op. Ex. 4 | Cu-Ag | 0.024 | 1 | G: V-220 | 7 | 4.3 | 3.6 x 10-5 | 4 |
| Op. Ex. 5 | Cu-Ag | 0.06 | 1 | G: V-220 | 7 | 4.5 | 3.8 x 10-5 | 5 |
| Op. Ex. 6 | Cu-Ag | 0.18 | 1 | G: V-220 | 7 | 4.6 | 4.5 x 10-5 | 5 |
| Op. Ex. 7 | Cu-Ag | 0.24 | 1 | G: V-220 | 7 | 4.3 | 6.0 x 10-5 | 4 |
| Op. Ex. 8 | Cu-Ag | 0.12 | 0.1 | G: V-220 | 7 | 0.5 | 3.1 x 10-5 | 3 |
| Op. Ex. 9 | Cu-Ag | 0.12 | 0.3 | G: V-220 | 7 | 1.6 | 3.5 x 10-5 | 4 |
| Op. Ex. 10 | Cu-Ag | 0.12 | 3 | G: V-220 | 7 | 14.9 | 5.2 x 10-5 | 5 |
| Op. Ex. 11 | Cu-Ag | 0.12 | 5 | G: V-220 | 7 | 25.1 | 1.6 x 10-2 | 5 |
| Op. Ex. 12 | Cu-Ag | 0.12 | 7.5 | G: V-220 | 7 | 27.9 | 9.6 x 10-1 | 5 |
| Op. Ex. 13 | Cu-Ag | 0.12 | 1 | G: WP-660 | 7 | 4.9 | 4.2 x 10-5 | 5 |
| Op. Ex. 14 | Cu-Ag | 0.12 | 1 | L: VA64P | 7 | 4.9 | 4.0 x 10-5 | 5 |
| Op. Ex. 15 | Cu-Ag | 0.12 | 1 | G: V-220 | 1 | 3.9 | 3.2 x 10-5 | 3 |
| Op. Ex. 16 | Cu-Ag | 0.12 | 1 | G: V-220 | 3 | 4.5 | 3.5 x 10-5 | 4 |
| Op. Ex. 17 | Cu-Ag | 0.12 | 1 | G: V-220 | 9 | 5.2 | 9.6 x 10-5 | 5 |
| Op. Ex. 18 | Cu-Ag | 0.12 | 1 | G: V-220 | 15 | 4.4 | 1.2 x 10-2 | 5 |

FIG. 3a

| | Particle | | | Charge Control Agent | | Characteristics | | |
|---|---|---|---|---|---|---|---|---|
| | Type | Plating | Cu Dia. | C Ctrl | C Ctrl | Thick | V Res | BF |
| | | [wt%] | [μm] | Agent | [wt%] | [μm] | [Ωcm] | Rank |
| Op. Ex. 2 | Ag-Cu | 10 | 1 | L: VA64P | 7 | 5.1 | 1.4 x 10-4 | 5 |
| Comp. Ex. 2 | Cu | 0 | 1 | L: VA64P | 7 | 1 | > 1.0 x 10-1 | 1 |
| Op. Ex. 19 | Ag-Cu | 1 | 1 | L: VA64P | 7 | 4.3 | 2.9 x 10-4 | 3 |
| Op. Ex. 20 | Ag-Cu | 2 | 1 | L: VA64P | 7 | 4.5 | 1.9 x 10-4 | 4 |
| Op. Ex. 21 | Ag-Cu | 5 | 1 | L: VA64P | 7 | 4.7 | 1.6 x 10-4 | 5 |
| Op. Ex. 22 | Ag-Cu | 15 | 1 | L: VA64P | 7 | 4.8 | 1.3 x 10-4 | 5 |
| Op. Ex. 23 | Ag-Cu | 20 | 1 | L: VA64P | 7 | 4.5 | 1.1 x 10-4 | 4 |
| Op. Ex. 24 | Ag-Cu | 10 | 0.1 | L: VA64P | 7 | 0.5 | 9.5 x 10-4 | 3 |
| Op. Ex. 25 | Ag-Cu | 10 | 0.3 | L: VA64P | 7 | 1.4 | 1.1 x 10-4 | 4 |
| Op. Ex. 26 | Ag-Cu | 10 | 3 | L: VA64P | 7 | 14.9 | 2.2 x 10-4 | 5 |
| Op. Ex. 27 | Ag-Cu | 10 | 5 | L: VA64P | 7 | 25.1 | 4.5 x 10-2 | 5 |
| Op. Ex. 28 | Ag-Cu | 10 | 7.5 | L: VA64P | 7 | 27.9 | 3.6 x 10-0 | 5 |
| Op. Ex. 29 | Ag-Cu | 10 | 1 | S-630 | 7 | 5.1 | 1.6 x 10-4 | 5 |
| Op. Ex. 30 | Ag-Cu | 10 | 1 | G: V-220 | 7 | 5 | 1.8 x 10-4 | 5 |
| Op. Ex. 31 | Ag-Cu | 10 | 1 | G: V-216 | 7 | 5 | 1.9 x 10-4 | 5 |
| Op. Ex. 32 | Ag-Cu | 10 | 1 | L: VA64P | 1 | 4.2 | 9.5 x 10-5 | 3 |
| Op. Ex. 33 | Ag-Cu | 10 | 1 | L: VA64P | 3 | 4.4 | 1.1 x 10-4 | 4 |
| Op. Ex. 34 | Ag-Cu | 10 | 1 | L: VA64P | 9 | 4.9 | 3.0 x 10-4 | 5 |
| Op. Ex. 35 | Ag-Cu | 10 | 1 | L: VA64P | 15 | 4.7 | 4.0 x 10-2 | 5 |

FIG. 3b

LIQUID DEVELOPER CONTAINING ELECTRO-CONDUCTIVE PARTICLES AND AN ELECTRO-CONDUCTIVE PATTERN FORMING METHOD USING SAID MATERIAL AND AN ELECTRO-CONDUCTIVE PATTERN FORMING APPARATUS USING SAID MATERIAL

CROSS-REFERENCE TO RELATED APPLICATIONS

This application claims priority under 35 USC §119 to Japanese Patent Application No. 2013-122583 filed on Jun. 6, 2013, now Japanese Patent Registration No. 5,336,680 registered on Aug. 9, 2013, the contents of which are hereby incorporated by reference.

BACKGROUND

1. Field of the Invention

The present invention is directed to electro-conductive deposition methods. More particularly, the invention is directed to a liquid toner development system, and pattern forming method and apparatus capable of electro-conductive deposition.

2. Description of Related Art

Electro-conductive patterning is generally within the field of "printed electronics", in which electrical conductors, or passive or active electrical components are formed on a substrate. Printed electronics is normally an additive process, wherein material is deposited on a substrate to form a predefined pattern. Multiple layers may be deposited of the same material or different, and may require secondary processes such as drying or curing to create the final form of electrical conductors or electrical components.

Many industrial printing technologies have been used for electro-conductive patterning. For example, screen printing, flexography, gravure, offset lithography and inkjet printing have been used for electro-conductive patterning with each having certain advantages and disadvantages. In the case of screen printing, it requires patterns formed from screens which are placed on a substrate, flooded with ink, then excess ink removed. This is a rudimentary process which is inexpensive, but is not suitable for high production volumes. Since the screen pattern is fixed, is not capable of producing variable patterns within a single set of screens. Gravure printing relies on engraved printing plates wherein the engraved features are filled with ink, then transferred to a substrate. This method is capable of high-quality and high-speed patterning, but is not capable of producing variable patterns within a single set of plates. Inkjet printing relies on a voltage impulse to propel droplets onto a substrate, resulting in a finally formed pattern. Inkjet printing is capable of high-quality printing, but is normally limited to a print swath of less than one inch. And further, print defects inherent in the technology normally requires an overlapping print mode ("shingling") for full quality printing. Thus, a swathing print technology such as inkjet is inherently slow unless many expensive printheads are ganged together to improve printing speeds. Therefore, inkjet is normally preferred for low-volume printing. Inkjet printers also require low viscosity fluids for proper jetting, resulting in inks with high levels of solvent is which must be removed after patterning. This results in a further decrease in net throughput. Inkjet printing is a digital technology capable of changing patterns from one substrate to the next, which is a favorable property.

Another printing technology not normally considered for electro-conductive patterning is electrophotographic (EP) printing. EP printing is a digital technology which relies on a multi-stage electrostatic transfer of printed particles, such as "toner", to a substrate. It is a page-wide technology capable of high speed and is capable of changing patterns from one substrate to the next. The electrostatic transfer process normally requires toner capable of holding an electrostatic charge, such as is common with polymers. The polymers normally interfere with the ability to form electrical conductors or components.

Previous attempts at conductive toner are discussed below:

Japanese Patent Laid-Open No. 2004-184598 teaches a liquid developer comprising toner particles in a binder resin with several metal particles evenly dispersed in a dispersion agent. The metal particles are of silver and copper, having an average metal particle diameter from 0.2 to 1.2 μm. The toner particle diameter is from 2.5 to 8 μm, and the developer contains 50 to 90 weight percent of toner particles. This is claimed to make the line edges sharper and reduce the circuit pattern line width. But, the method of '598 requires a high sintering temperature (1,000° C., for example). This sintering temperature is incompatible with substrates used for printed circuit applications.

Japanese Patent Laid-Open No. 2004-048030 describes an electronic circuit manufacturing method and manufacturing apparatus using metal-containing charged toner particles with resin containing the metal particles. The metal is silver or copper, wherein the metal particle concentration rate is 10~90 weight percent. It is pressure transferred to an intermediate transfer drum, then onto a substrate. The metal particles become the plating core and act like a catalyst for a plating response. It claims to reduce costs, increase productivity of multiproduct and small-quantity production and shorten the evaluation cycle for manufacturing. The method of '030 also relies on a plating process (electrolytic or non-electrolytic) to improve the electrical conductivity, is giving rise to environmental issues normally associated with traditional plating processes.

Japanese Patent Laid-Open No. 2005-181621 teaches a developer which uses toner particles of copper/silver alloys to obtain a golden color output. The composition of the alloy is adjusted to affect the golden color. It claims that the resolution of wiring circuit without causing poor conductivity and the golden-color output can be improved.

The objective of the '621 reference is not to achieve high electrical conductivity, but rather to obtain a specific golden color through the use of discrete alloy compositions. Additionally, a large amount of binder resin is used in order to improve the ability to control the charge, fixing, and dispersion, thereby reducing the opportunity for high conductivity. For Example, Example 1 in the document provides 70 parts of wax to 20 parts of metal particles and copolymers (such as lauryl methacrylate). Since '621 relies on an intermediate transfer process, a high level of wax and resins is required to achieve intended results.

These examples describe circuit formation methods using electro-photography as being superior to conventional lithography, screen printing, and inkjet methods in terms of simplicity, low cost and mass-productivity. However, achieving high conductivity with EP technology has yet to be achieved.

Other issues not taught in these references, but required for an EP technology capable of reliably forming electro-conductive circuits, is to provide high adhesion to a substrate and with little to no background fogging.

It is therefore an object of the present invention to provide a liquid electrophotographic toner, apparatus, and method capable of patterning electrical conductors and components having high conductivity, high substrate adhesion, and with little to no background fogging.

SUMMARY

A novel liquid toner development system is disclosed for electro-conductive deposition applications. In particular, the liquid toner includes electro-conductive is particles containing a core-shell of Ag—Cu, or Cu—Ag. A novel deposition apparatus and deposition method is also disclosed.

BRIEF DESCRIPTION OF THE DRAWINGS

FIGS. 1*a*', 1*b*', and 1*b*" show cut-away illustrations, not to scale, of imperfectly formed core-shell electro-conductive particles.

FIG. 1*c*' shows a cut-away illustration, not to scale, of an electro-conductive toner particle which is made of an imperfectly formed core-shell electro-conductive particle.

FIGS. 3*a-b* provide experimental data inputs and results in tabular form.

DETAILED DESCRIPTION

It is to be understood that various omissions and substitutions of equivalents are contemplated as circumstances may suggest or render expedient, but these are intended to cover the application or implementation without departing from the spirit or scope of the claims of the invention described herein. The present invention is capable of other embodiments and of being used in various applications. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Further, the terms "a" and "an" herein do not denote a limitation of quantity, but rather denote the presence of is at least one of the referenced item.

Figure 1A:
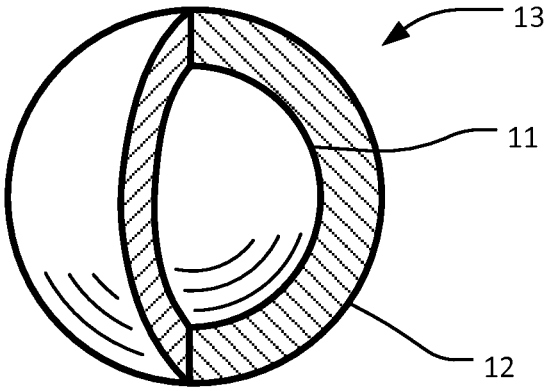
FIG. 1*a-b* are cut-away illustrations, not to scale, of exemplary core-shell electro-conductive particles.
Figure 1A:
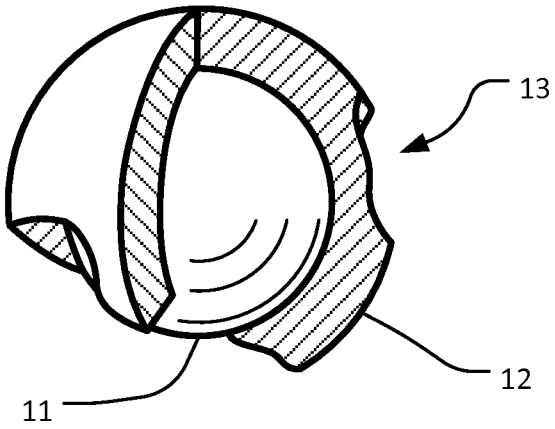
Figure 1B:
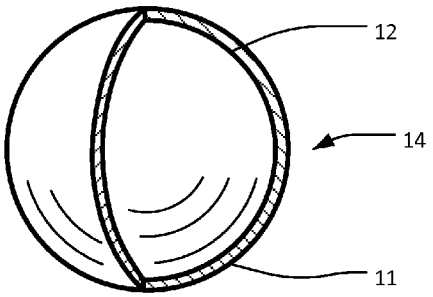
Figure 1B:
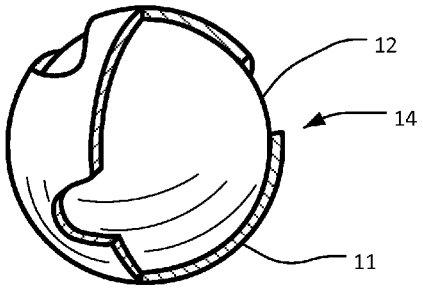
Figure 1B:
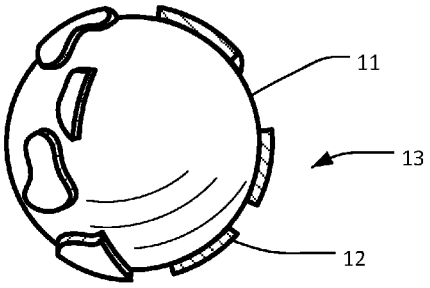

Reference is now made to FIG. 1*a-b* which illustrates core shell electro-conductive particles.

FIG. 1*a* shows a core of silver 11 (having a chemical symbol Ag) plated by a shell of copper 12 (having a chemical symbol Cu). Copper-plated silver, designated Cu—Ag, is shown in reference number 13. Cu—Ag 13 is not commercially available, but was plated by the inventors using an electroless process including a copper salt and EDTA in an aqueous solution. Cu—Ag 13 in the range of 0.1 μm diameter to 7.5 μm diameter were successfully plated and tested.

FIG. 1*b* shows a core-shell electro-conductive particle having a core of copper 12 and a shell of silver 11. A silver plated copper particle, designated Ag—Cu, is shown in reference number 14. Particles of this type are available from Fukuda Metal Foil & Powder Co., Ltd. or Kiyokawa Plating Industry Co., Ltd., and may also be prepared by the method shown in Japanese Patent Laid-Open No. 2001-214080 Bulletin hereby incorporated by reference in its entirety. Ag—Cu 14 in the range of 0.1 μm diameter to 7.5 μm diameter were successfully tested.

In FIGS. 1*a*'-*b*', irregularly shaped shells are shown, illustrating that the coating need not be perfectly coated to function properly.

Cu—Ag 13 or Ag—Cu 14 may be referred to collectively as "conductive particle(s) 13 or 14. The Cu—Ag 13 or Ag—Cu 14 may contain small amounts of impurity elements in actual operation.

Figure 1C:
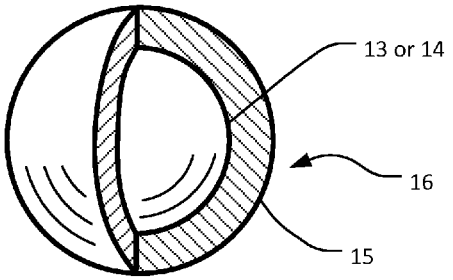
FIG. 1*c* shows a cut-away illustration, not to scale of an exemplary electro-conductive toner particle.
Figure 1C:
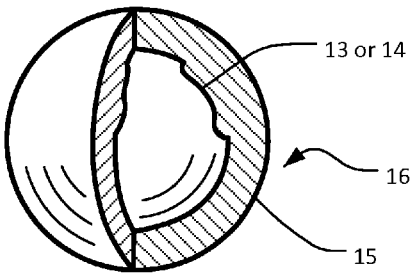

FIG. 1*c* shows an electro-conductive toner particle 16, which includes conductive particle 13 or 14, coated by a charge control agent 15 (described below) to form a conductive toner particle 16. To affect or enhance the electrostatic charge of conductive particles 13 or 14, additives known as charge directors or charge control agents (15) provide a coating. In this application, denaturalized polyvinylpyrrolidone (PVP) such as alkylation polyvinylpyrrolidone, acetic acid vinylpyrrolidone polymeric resin, acrylamide functionalized polyvinylpyrrolidone is suitable for the charge control is agent 15 in the liquid developer. In addition to denaturalized PVP, synthetic resin such as ethyl cellulose, methyl methacrylic acid resin, acrylic acid resin, alkyd resin, polyethylenimine oligomer, organic acid such as rhodine, phthalic acid, maleic acid, fumaric acid, lauric acid and stearic acid can be used as the charge control agent. A blend of denaturalized PVP resin, synthetic resin and organic acid may also be used. These charge control agents coat the conductive particles 13 or 14, forming a shell over the conductive particles 13 or 14, resulting in conductive toner particles 16. These charge control agents 15 enable the conductive toner particles (16) to accept a charge in the developer and minimize clumping, thereby enabling the conductive toner particles 16 to flow uniformly.

FIG. 1*c*' shows an electro-conductive toner particle 16, wherein charge control agent 15 is shown coating an irregularly shaped conductive particle 13 or 14.

It is preferable that the solid content composition of charge control agents 15 have a weight ratio between 1% to 15% of the combined total of conductive toner particle 16. It is more preferred that this ratio is between 3% and 9%.

Figure 1D:
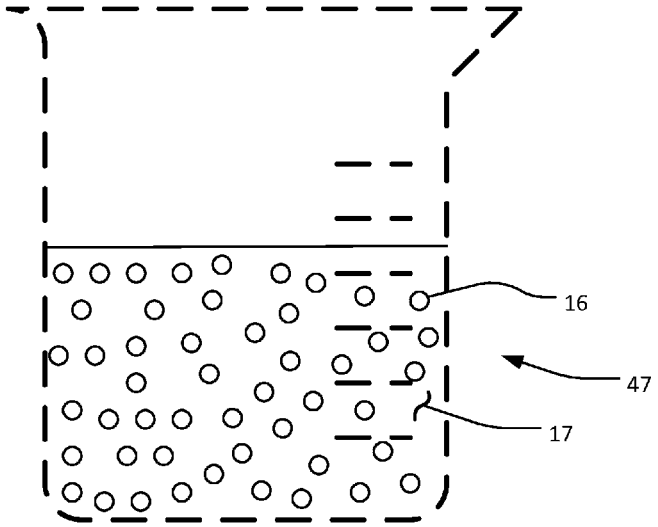
FIG. 1*d* illustrates a liquid developer.

FIG. 1*d* shows a liquid developer 47 in an arbitrary container. The container is shown in dashed lines as not relevant to the description. The liquid developer 47 includes conductive toner particles 16 in a dispersion medium 17. The dispersion medium 17 is an insulative liquid having electric resistivity of $1\times10^9$ Ωcm or higher. Example liquids capable of use as a dispersion medium 17 include aliphatic hydrocarbon, petroleum naphtha, other hydrocarbons and silicone oil. As to the aliphatic hydrocarbon, the following products are usable: Isopar L, G, H (ExxonMobil), IP Solvent 1620 (Idemitsu Petrochemical), Solutol (Phillips Petroleum), as petro-based naphtha Naphtha No. 1 through 6, other hydrocarbons such as Solvesso 100 and 150, Shell S.B.P., ShellSol (Shell Oil), Pegasol 1030, 2130, 3040, AS-100, ARO-40 (Mobil), Isododecane (BP Chemical), as silicone oil such as synthetic dimethylpolysiloxane, cyclic methyl poly siloxanes as well as KF96L (Shinetsu Silicone), KF994 (Shinetsu Silicone), and SH200 (Toray Dow Corning silicone). Further details related to the liquid developer 47 will be provided in the upcoming examples.

A conductive pattern forming apparatus, shown in FIG. 2, will now be described. A cylindrical drum forms an image holding body 10, which is coated with a photo receptive surface (not shown). The image holding body 10 is commonly referred to as a photoconductor drum. A latent image (not shown) is formed on the image holding body 10 which is charged evenly by an electrostatic charger 21. An image pattern is exposed by exposure device 31 which may be a light source such as a laser or an array of light emitting diodes (LEDs).

Figure 2:
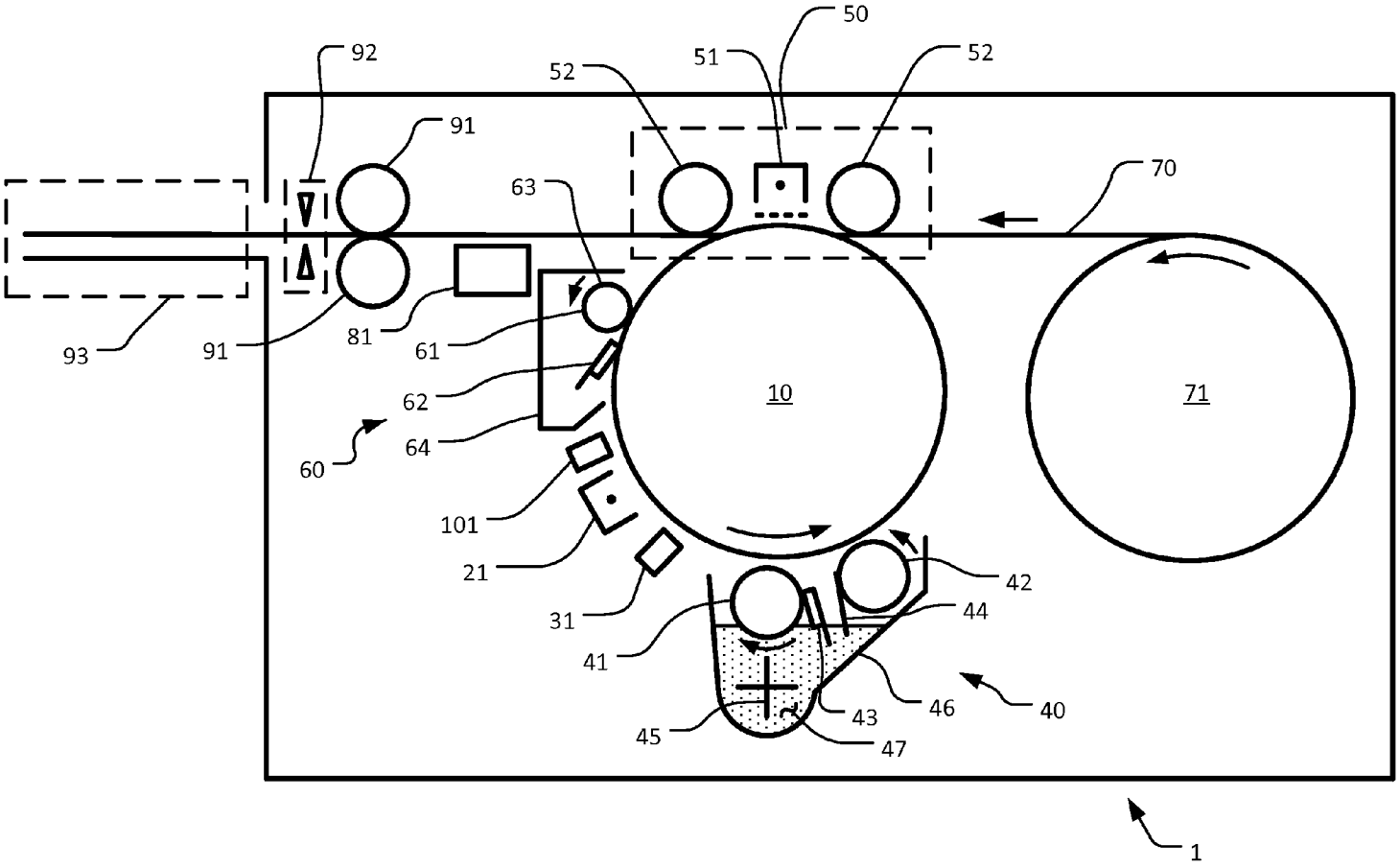
FIG. 2 schematically depicts, in cross-section, an exemplary conductive pattern forming apparatus.

FIG. 2 discloses a so-called roller development method wherein the liquid developer 47 is lifted up by development roller 41 in developer device 40. But not limiting to this method, other methods such as a method using a dish-shaped electrode (not shown) can be used if needed as long as the liquid developer 47 touches the image holding body 10.

When the density of conductive toner particles 16 is high, and the viscosity of liquid developer 47 is high, it is possible for a separate roller (not shown) to apply the liquid developer 47 on development roller 41 and let it contact image holding body 10 (high viscosity contact development method).

Developer device 40 includes a developer housing 46, containing the liquid developer 47 in addition to a development roller 41, a squeeze roller 42, a blade 43, a scraper 44, and a churning paddle 45. The function of these components will now be described. Liquid developer 47 is provided from a supply device (not shown). The churning paddle 45 mixes the liquid developer 47, causing conductive toner particles 16 to stay suspended, maintaining uniformity throughout dispersion medium 17. When liquid developer 47 is left unattended, and if the specific gravity of electro-conductive particles is greater than the specific gravity of the disperse medium, sedimentation of conductive toner particles 16 may occur. In these cases churning paddle 45 is used to prevent sedimentation.

Development roller 41 picks up liquid developer 47, causing a film (not shown) of fluid to contact image holding body 10 through a gap separating development roller 41 and image holding body 10. Conductive toner particles 16 are transferred electrostatically to the imaged portion of the image holding body 10 (the is "developed image"). In the case of the roller development method, a gap is set up between development roller 41 and image holding body 10. During operation the liquid developer fills this gap. When the density of conductive toner particles 16 is low, and the viscosity of liquid developer 47 is low, liquid developer 47 is lifted to make contact to the image holding body 10 by rotating the development roller 41 (roller development method by lifting).

The gap between development roller 41 and image holding body 10 is recommended to be set between 50 μm to 300 μm for said roller development method by lifting. For the roller development method by lifting, a squeezing measure is preferred, although it is not needed for the high viscosity contact development method. The squeezing measure can be selected from the roller method, corona method, air method and etc. The roller method is to spin squeeze roller 42 which is near image holding body 10 at high speed to let the excess developer liquid on image holding body 10 adhere, then scrape it off with scraper 44. The corona method is to use the corona discharger (not shown) instead of squeeze roller 42 It is effective to squeeze off the excess liquid developer 47 electrically. The air method is to squeeze the excessive liquid with air pressure (not shown).

Most of the liquid developer 47, excluding the transferred conductive toner particles 16, are removed from development roll 41 by a blade 43. The remaining layer of liquid developer 47 on image holding body 10 is metered off by the squeeze roller 42. FIG. 2 shows components to enable the roller squeeze method. Squeeze roller 42 maintains a gap to the image holding body 10 from 20 μm to 150 μm while spinning. The rotation speed of squeeze roller 42 is recommended about 2 to 4 times the rotation speed of image holding body 10.

Squeeze roller 42 is cleaned of liquid developer 47 by the scraper 44. The way to squeeze out the liquid can be chosen from the roller method, corona method and air method depending on the application.

The developed image rotates to a transfer unit 50. The transfer unit 50 comprises regulating rollers 52 and a transfer charger 51. Media 70, which is dielectric, is transported from the media roll 71 to the transfer unit 50 by friction force of feeding rollers 91. Transfer charger 51 charges the media 70 to a polarity opposite the charge is of the conductive toner particles 16.

The conductive toner particles 16 are transferred to the media 70 assisted by mechanical force provided by regulating rollers 52, which press the media 70 against the image holding body 10.

The media 70, now including conductive toner particles 16, traverses past a dryer 81 wherein liquid such as dispersion medium 17 is evaporated. The media 70 then traverses past feeding rollers 91, then cut to the appropriate size by media cutter 92 and ejected by media ejection unit 93.

Any residual liquid developer, including residual conductive toner particles 16, are cleaned from image holding body 10 by cleaning unit 60. Cleaning unit 60 comprises cleaner housing 64, a cleaning roller 61 and a cleaning blade 62. The residual conductive toner particles 16 on image holding body 10 are uplifted by wetting liquid (not shown) through wetting liquid supply section (not shown) to cleaning roller 61. This roller rotates such that mating surfaces are moving in opposite directions, uplifting any residue from the surface of image holding body 10. The uplifted residue is scraped off by the cleaning blade 62. The scraped toner particles are recovered into a waste liquid tank (not shown) connected to cleaner housing 64. The wetting liquid (not shown) will preferably be the same as the dispersion medium 17.

Following the cleaning step, any remaining static charge on image holding body 10 is removed by eraser 101, thereby reinitialized the surface.

Returning again to the developer device 40, a gap of about 50 μm to 300 μm between the development roller 41 and image holding body 10 is maintained. The liquid developer 47, which is picked up by the development roller 41, sufficiently transfers the electro-conductive toner particles 16 to the image holding body 10. The gap is determined by the viscosity of the liquid developer 47, which is in part determined by the conductive toner particle 16 density. A narrower gap of 50 μm is sufficient for lower viscosity liquids, while a gap of 300 um may be preferred for higher viscosity liquids. The churning paddle 45 rotates continuously during operation, maintaining a uniform dispersion of conductive toner particles 16 in the liquid developer 47, thereby preventing sedimentation.

In an alternate developer device 40 configuration for high viscosity liquids, an intermediate roll (not shown) between liquid developer 47 and development roller 41 may be used.

For either configuration, the developer device 40 includes a squeeze roller 42 which rotates counter to the direction of the image holding body 10 and maintains a gap between these components. Squeeze roller 42 preferably rotates at a surface speed 2 to 4 times greater than the surface speed of the image holding body 10. By so doing, the squeeze roller 42 regulates the thickness of the liquid developer 47. This is most useful for lower viscosity liquid developers 47 as low viscosity fluids, being more like water, are more likely to form uncontrolled patterns on the image holding body 10. A gap of 20 μm to 150 μm is preferred, depending on the viscosity of the liquid developer 47. A scraper 44 is in contact with squeeze roller 42, causing excessive fluid buildup to be scraped off and returned to the developer device 40.

Non-contact alternatives to a squeeze roller 42 for regulating the thickness of liquid developer 47 includes a corona generating conductor (such as a wire, not shown), capable of generating a potential between the corona conductor and the coated image holding body 10. A corona discharge creates an ion curtain extending across the width of the image holding body, impinging on the liquid coating, effectively leveling at least a portion of the coating. Another non-contact alternative is the use of an air curtain (not shown).

Turning now to the transfer unit 50 shown in FIG. 2, this module transfers the toner image on the image holding body 10 to the media 70. Shown in FIG. 2 is a direct transfer method, wherein the developed image is transferred directly from the image holding body 10 to the media 70. Alternately, an intermediate transfer member (not shown) may receive the developed image, then transfer the image to media 70. Intermediate transfer members are often used when multiple images are to be formed. The multiple images may be accumulated on the intermediate transfer member, thereby enabling a single transfer to the media 70.

Direct transfer, such as with transfer unit 50, may rely on mechanical or electrostatic means, but normally a combination of both. Regulating rollers 52 apply is pressure between the media 70 and image holding body 10. The media 70 may travel at a speed slightly different than the surface speed of the image holding body 10. The pressure, in combination with the difference in surface speed, causes a shear stress on the image, encouraging efficient transfer. The regulating rollers 52 may also be electrostatically charged to provide an electrical bias capable of attracting the toner to the media 70. A corona conductor, such as transfer charger 51, may also provide an electrical bias. A preferred embodiment includes a corona conductor for transfer charger 51. It is also preferred that regulating rollers 52 do not directly contact image holding body 10 to minimize the disturbance of the transferred image.

Once the electro-conductive image has been transferred to the media 70, the image is fixed to the media 70 via a sintering furnace (not shown). A sintering furnace may be attached to the printer, or may be a separate unit.

In general, sintering relies on one or more energy sources to evaporate or burn off any remaining dispersion medium 17 or charge control agent 15, consolidate conductive particles 13 or 14 and fix them to the media 70.

Sintering normally consolidates particles (such as conductive particles 13 or 14) at temperatures below the melting point of the conductive particles 13 or 14, or the media 70, whichever is lower. Energy sources, and time/temperature profiles at least depend on the particle material (such as silver 11 or copper 12), the diameter of the conductive particles 13 or 14, the dispersion medium 17, the media 70, the level of conductivity required, and the operating environment of the electro-conductive circuit. Energy sources may be, for example, hot air, light, electromagnetic, resistance, or plasma. Additionally, it is preferred to sinter under a reduction environment by introducing hydrogen or non-oxygen gas since copper 12 is easily oxidized in air. A sintering apparatus will differ based on the many variables described heretofore. Therefore, an exemplary apparatus is not shown in the figures.

Metal particles achieve various levels of sintering as temperature increases. For example, silver particles may start to "neck", connecting particles to particles, at a temperature of about 150° C., with more visible necking at 180° C. But as the is temperature increases to 250° C., silver atoms diffuse from grain boundaries at the intersections and continue to deposit on the interior surface of the pores, thereby filling up the remaining space, even though the melting temperature of silver 11 is much higher at about 960° C. Thus, a media 70 such as paper having a thermal limit of about 120° C. would limit the sintering process. But polyimide film, having a glass transition temperature of about 350° C., will enable a more robust sintering process. For green ceramic, sintering temperatures of the media 70 may approach the melting temperature of the particles, therefore one does not limit the other.

For the applications disclosed here, media 70 may be paper, resin film, ceramic green sheet, and so on as long as it is insulative material.

EXAMPLES

Operational Example 1

Cu—Ag 13 particles were prepared with following method: 4 g of copper (II) sulfate pentahydrate was dissolved in 400 g of purified water, then 4 g of ammonia water was added while stirring. Additionally, 8 g of ethylenediaminetetraacetate tetrasodium salt (EDTA 4Na) was added while stirring. Separately, 0.1 g of bipyridyl was dissolved in 8 g of ethyl alcohol, then it was added to the above copper sulfate solution to prepare the plating solution. 200 g of silver particle S211A (manufactured by Daiken chemical Co., Ltd., average particles diameter 1 μm) was added to the plating solution and dispersed for 2 minutes with 9500 rpm spin on the homogenizer. Then 4 g of formalin was added slowly while stirring at 100 rpm, heated at 40° C.~50° C. and continued stirring for 30 minutes. After this process, it was rinsed 3 times with purified water, then dried for 2 hours at 80° C., resulting in Cu—Ag 13 particles.

A solution for forming a charge control agent 15 was prepared according to the following method: 7.5 g of Ganex V-220 (alkylated polyvinylpyrrolidone, made by ISP Japan) was added to 50 g of Isopar L (ExxonMobil) and heated to 50° C. to dissolve and let it cool down to room temperature.

Conductive toner particles 16 were formed by adding 100 g of the aforementioned Cu—Ag 13 particles to the aforementioned solution. In addition, 250 g of alumina balls of 5 mm diameter were included. This was sealed in a container and is rotated at a rate of 90 rpm for 2 hours on a ball mill rotation platform. When finished, the alumina balls were separated, resulting in Cu—Ag 13 particles coated with charge control agent 15 and the solution.

The liquid developer 47 was prepared by combining the aforementioned Cu—Ag 13 particles coated with charge control agent 15 and the solution with 160 g of Isopar L. This resulted in the liquid developer 47 having a charge control agent solid part ratio of 7.0% by weight. The term "charge control agent solid part ratio" is defined as the ratio of weight of the charge control agent solid part to the total weight of charge control agent sold part and weight of Cu—Ag particles. The particles were separated from the solution and analyzed using an inductively coupled plasma-atomic emission spectrometer (ICP-AES). The copper 12 content was 0.12 weight percent of the total (copper and silver). The diluted liquid developer was dried and observed under the scanning electron microscope (SEM) and it was verified that single conductive toner particles 16 were made of single electro-conductive particles.

The liquid developer 47 of Example 1 was used in the conductive pattern forming apparatus shown in FIG. 2. Polyimide having a thickness of 25 μm was used as dielectric media 70 in roll form. A positively charged single layer organic photoconductor was used for image holding body 10 with a rotation speed of 50 mm/s, having an initial surface potential charged of +600 V. An LED exposure device 31 was used to expose the image. A conductive development roller 41 was charged at the potential of +450 V, positioned to have a gap of 200 μm between the development roll 41 and image holding body 10 and rotated at the speed of 150 mm/s.

A squeeze roller 42 was charged at the potential of +450 V, positioned to have a gap of 50 μm between the squeeze roller 42 and image holding body 10. The squeeze roller 42 was rotated at a speed of 150 mm/s. The conductive toner particles 16 on image holding body 10 were transferred to media 70 by applying −1 KV on the grid of scorotron which was used as a scorotron system transfer charger 51 in transfer unit 50. For this step, regulating roller 52 was placed near the image holding body, however at the location where it did not touch the image holding body, in order for the media to contact the image holding body over the scorotron charging width. After the is media 70 on which the conductive toner particles 16 were transferred was cut by media cutter 92 to appropriate length, it was sintered in a sintering furnace apparatus at 250° C. temperature for one hour.

Testing of the resulting electro-conductive pattern was conducted after sintering, having a line width 0.3 mm, length 5 mm, and 5.0 μm thick. The electro-resistance was measured by 4-terminal sensing, having a volume resistivity of $4\times10^{-5}$ Ωcm. The image background fogging was ranked subjectively on a scale of 1 to 5, with 5 being the best (no visible background fogging).

Operational Example 2

Silver-plated copper particles can be obtained commercially as well as they can be manufactured through the method such as shown in the Japanese Patent Laid-Open No. 2001-214080 bulletin.

A solution for forming a charge control agent was prepared according to the following method: 1.0 g of oleic acid was dissolved in 100 g of ethyl alcohol placed in a container.

Conductive toner particles 16 were formed by providing 200 g of the aforementioned Ag—Cu 14 particles, in addition to 5 mm glass beads, to a container of the aforementioned solution. It was rotated for 4 hours on a ball mill rotation platform at 100 rpm speed. The glass beads were then separated out, and the remaining coated particles were dried at 80° C. for 1 hour in a dryer, resulting in conductive toner particles 16.

The liquid developer 47 was prepared for Example 2 by providing 0.56 g of Luviskol VA64P (vinyl acetate-vinyl pyrrolidone copolymerized resin, made by BASF), dissolving it in a mixed solvent of 12.0 g of ethyl acetate and 12.0 g of xylene, then 3.73 g of rhodine and 1.87 g of maleic acid. Additionally, 1.34 g of Beckosol 1334-EL (alkyd resin, made by DIC) were dissolved. The mixture and 100 g of aforementioned surface treated silver plated copper (Ag—Cu 14) particles were sealed in a container with 250 g of 5 mm diameter glass beads, then rotated at a speed of 100 rpm for 4 hours on a ball mill rotation platform. When finished, hot air was blown-in to evaporate the ethyl is acetate and xylene. 50 g of Isopar L (made by ExxonMobil) was added and resealed and rotated at a speed of 100 rpm for 4 hours on the ball mill rotation platform. Then, the glass beads and surface treated silver plated copper (Ag—Cu 14) particles were separated. An additional 160 g of Isopar L was added to complete the liquid developer 47. The charge control agent 15 solid part ratio to the liquid developer 47 was 7.0% by weight.

The liquid developer 47 of Example 2 was used in the conductive pattern forming apparatus shown in FIG. 2. The evaluation was done after the image with the electroconductive particles was formed and sintered the same way as Operation Example 1. In addition, rhodine, maleic acid and alkyd resin were charge control agents and the charge control solid part ratio for the liquid developer was 7.0 weight percent. Also, the toner particle which was the silver plated copper particle in the liquid developer was analyzed with the inductively coupled plasma-atomic emission spectrometry (ICP-AES) equipment and the silver content was 10 weight percent against the total of copper and silver. The diluted liquid developer was dried and observed under the scanning electron microscope (SEM) and it was verified that single conductive toner particles 16 were made of single electroconductive particles. The liquid developer's toner particles were positively charged and it was possible to develop the negatively charged latent image. The electroconductive pattern's thickness and electrical resistance of the image part, line width 0.3 mm and length 5 mm, were measured after sintering. The thickness of electroconductive pattern formed was 5.1 μm and the result of electrical resistance showed the conductive pattern's volume resistivity as $1.4\times10^{-4}$ Ωcm. The image background fogging rank was 5.

Test Data

Comparison Example 1, Operation Example 3~7

Copper plating was varied from 0% to 0.24% weight. All other variables were the same as Operational Example 1.

Operation Example 8~12

Silver particle diameter was varied from 0.1 μm to 7.5 μm. All other variables were the same as Operational Example 1.

Operation Example 13

Charge control agent 15 was changed to "G: WP-660" as follows. All other variables were the same as Operational Example 1.

7.5 g of Ganex WP-660 (alkylated polyvinylpyrrolidone, made by ISP Japan) was added to 50 g of Isopar L (made by ExxonMobil) and heated to 80° C. to dissolve and let it cooled down to the room temperature. This solution was slightly milky. 100 g of copper plated silver (Cu—Ag 13) particles prepared by the same method as Operation Example 1 were added to the solution and additionally 250 g of alumina balls of 5 mm diameter were added. They were placed and sealed in a container and rotated at a rate of 90 rpm for 2 hours on a ball mill rotation platform. When it was finished, the whole content was taken out and the alumina balls were separated. The liquid developer was prepared after 160 g of Isopar L was added.

Operation Example 14

Charge control agent 15 was changed to "L: VA64P" as follows. All other variables were the same as Operational Example 1.

3 g of rhodine and 3 g of maleic acid were dissolved in the mixed solution of 12.0 g of ethyl acetate and 12.0 g of xylene to prepare the organic acid solution. 1.5 g of Luviskol VA64P (vinyl acetate-vinyl pyrrolidone copolymerized resin, made by BASF) was dissolved in the mixed solvent. Additionally, 100 g of copper plated silver (Cu—Ag 13) particles which were prepared with the same method as Operation Example 1 was added with 250 g of alumina balls of 5 mm diameter in a container and sealed. The container was rotated at a speed of 90 rpm for 2 hours on the ball mill rotation platform then opened. Hot air from dryer was blown-in to evaporate the ethyl acetate and xylene. 50 g of Isopar L (made by ExxonMobil) was added and resealed and rotated again at a speed of 90 rpm for 2 hours on the ball mill rotation platform. Then, the container was opened and whole content was taken out to separate out the alumina balls. Additionally, 160 g of Isopar L was added to prepare the liquid developer.

Operation Example 15~18

Charge control agent 15 included "G: V-220" as with Operational Example 1, but coating weight (C Cntl wt %) was varied from 1% to 15% weight. All other variables were the same as Operational Example 1.

Comparison Example 2, Operation Example 19~23

Silver plating on copper was varied from 0% to 20% weight. All other variables were the same as Operational Example 2.

Operation Example 24~28

Copper particle diameter was varied from 0.1 μm to 7.5 μm, and silver plating was held at 10% weight. All other variables were the same as Operational Example 2.

Operation Example 29

Charge control agent 15 was changed to "S-630" as follows. All other variables were the same as Operational Example 2.

0.73 g of S-630 (vinyl acetate-vinyl pyrrolidone copolymerized resin, made by ISP Japan) was dissolved in the mixed solution of 12.0 g of ethyl acetate and 12.0 g of xylene and in addition 3.64 g of rhodine and 1.82 g of maleic acid were dissolved in the mixed solution. Additionally, 1.31 g of Beckosol 1334-EL (alkyd resin, made by DIC) was dissolved. The mixture and 100 g of surface treated silver plated copper (Ag—Cu 14) particles prepared by the same method as Operation Example 2 were placed and sealed in a container with 250 g of glass beads of 5 mm diameter and rotated at a speed of 100 rpm for 4 hours on the ball mill rotation platform. When finished, hot air was blown-in to evaporate dry the ethyl acetate and xylene. 50 g of Isopar L (made by ExxonMobil) was added and resealed and rotated at a speed of 100 rpm for 4 hours on the ball mill rotation platform. Then, the glass beads were separated using the metal screen of 1 mm opening. Additionally, 160 g of Isopar L was added to prepare the liquid developer.

Operation Example 30

Charge control agent 15 was changed to "G: V-220" as follows. All other variables were the same as Operational Example 2.

3.75 g of Ganex V-220 (alkylated polyvinylpyrrolidone, made by ISP Japan) and 3.75 g of Beckosol 1334-EL (alkyd resin, made by DIC) were added to 50 g of Isopar L (made by ExxonMobil) and heated to 50° C. to dissolve. 100 g of surface treated Ag—Cu 14 particles which were prepared with same method as Operation Example 2 was added to the liquid and 250 g of glass beads of 5 mm diameter were added. It was sealed in a container and rotated at a rate of 100 rpm for 4 hours on a ball mill rotation platform. When it was finished, the glass beads were separated using the metal screen of 1 mm opening. 160 g of Isopar L was added, completing the preparation of the liquid developer 47.

Operation Example 31

Charge control agent 15 was changed to "G: V-216" as follows. All other variables were the same as Operational Example 2.

7.5 g of Ganex V-216 (alkylated polyvinylpyrrolidone, made by ISP Japan) was placed in 50 g of Isopar L (made by ExxonMobil) and heated to 50° C. to dissolve. 100 g of surface treated Ag—Cu 14 particles which were prepared with the same method as Operation Example 2 was added to the liquid and 250 g of glass beads of 5 mm diameter were added. It was sealed in a container and rotated at a rate of 100 rpm for 4 hours on a ball mill rotation platform. When it was finished, the glass beads were separated using the metal screen of 1 mm opening. 160 g of Isopar L was added, completing the preparation of the liquid developer 47.

Operation Example 32~35

For these examples, the charge control agent 15 "L: VA64P" included varying weight ranging from 1% to 15% weight. All other variables were the same as Operational Example 2.

The developer was formulated with same the ratios of charge control agent, Luviskol VA64P (vinyl acetate-vinyl pyrrolidone copolymerized resin, made by BASF) and rhodine, maleic acid, Beckosol 1334-EL (alkyd resin, made by DIC) as in Operation Example 2, although the total amount was different. The charge control agent 15 solid part ratios contained in the liquid developer were 1, 3, 9 and 15 weight percent respectively.

See FIG. 3*a* and FIG. 3*b* for a table of input variables and results.

Discussion

It is clear from FIG. 3*a* and FIG. 3*b* that the dominant variable in achieving low volume resistivity and a favorable subjective ranking for background fogging is a conductive toner particle 16 containing a core-shell of Cu—Ag 13 or Ag—Cu 14. Volume resistivity decreased relative to unplated copper 12 or silver 11 by at least one order of magnitude and, in most cases, three orders of magnitude. Further, background fogging for unplated copper 12 or silver 11 was poor in either case with a subjective ranking of 1, indicating a high level of background fogging. In this case, background fogging deposits conductive components in unwanted regions of the media 70. For printed electronics applications, this is not only objectionable, but may alter the function of the printed electronic device—perhaps causing shorting of conductive traces or altering the values or even the functionality of components such as resistors, capacitors, or transistors.

A core-shell of Cu—Ag 13 was shown to be effective over the entire range tested—from 0.012% of total weight to 0.24%, and from silver 11 diameters ranging from 0.1 μm to 7.5 μm.

A core-shell of Ag—Cu 14 was shown to be effective over the entire range tested—1% of total weight to 20%, and from copper 12 diameters ranging from 0.1 μm to 7.5 μm.

Even with a range of charge control agent 15 chemistries and thicknesses, a core-shell having a core of either silver 11 or copper 12, and wherein the shell is different from the core and is either copper 12 or silver 11, surprising improvements resulted in the overall capabilities of a conductive pattern forming apparatus 1 wherein a liquid developer 47 is used.

It should also be noted that achieving a minimum thickness of an electro-conductive pattern is required if the conductive pattern forming apparatus 1 is to have industrial applicability. FIG. 3*a* and FIG. 3*b* show substantial increases in the thickness is of the electro-conductive pattern in nearly every case. In some cases, pattern thickness was increased by a factor of more than 20. This enables the technology to be used for many higher current carrying applications, thereby improving the industrial applicability. A single layer thickness, wherein the conductive pattern thickness is about the same as the diameter of conductive toner particles 16, the probability of continuous conductivity is low. Therefore, good conductivity, the pattern thickness needs to be at least several times greater than the diameter of the particle as seen in the experimental results.

It is unclear to the inventors why Cu—Ag 13 particles or Ag—Cu 14 particles result in these substantial improvements over silver 11 or copper 12 particles alone. It is theorized that the chargeability improves as the polarized or ionized charging control agent can adhere easier if silver and copper exist within the particle. However, this phenomenon was found through the inventor's experimental work and the true mechanism is not necessarily clear.

It is contemplated, and will be clear to those skilled in the art that modifications and/or changes may be made to the embodiments of the disclosure. Accordingly, the foregoing description and the accompanying drawings are intended to be illustrative of the example embodiments only and not limiting thereto, in which the true spirit and scope of the present disclosure is determined by reference to the appended claims.

What is claimed is:

1. An electro-conductive toner fluid composition, comprising:

a. core-shell particles containing a core portion selected from the group comprising copper and silver, and a shell portion selected from the group comprising copper and silver, wherein the shell portion is different from the core portion;

b. a charge control agent; and c. a liquid dispersion agent.

2. The electro-conductive toner fluid composition of claim 1, wherein the core portion of said core-shell particles is silver, and the shell portion of said core-shell particles is copper, wherein said copper comprises 0.012 to 0.24 total weight percent of said core-shell particles.

3. The electro-conductive toner fluid composition of claim 1, wherein the core portion of said core-shell particles is copper, and the shell portion of said is core-shell particles is silver, wherein said silver comprises 1 to 20 total weight percent of said core-shell particles.

4. The electro-conductive toner fluid composition of claim 1, wherein said charge control agent contains a modified polyvinylpyrrolidone.

5. The electro-conductive toner fluid composition of claim 1, wherein said charge control agent containing a modified polyvinylpyrrolidone comprises 1 to 15 total weight percent of said modified polyvinylpyrrolidone and conductive toner particle.

6. The electro-conductive toner fluid composition of claim 1, wherein said liquid dispersion agent is a liquid having an electrical resistivity of about $1\times10^{9}$ ohm-cm or greater.

7. An electro-conductive pattern forming apparatus comprising:

a. an image holding body;

b. a developer device including a development means, a squeeze means, and a liquid developer, wherein said liquid developer includes conductive particles;

c. core-shell particles containing a core portion selected from the group comprising copper and silver, and a shell portion selected from the group comprising copper and silver, wherein the shell portion is different from the core portion;

d. a charge control agent; and e. a liquid dispersion agent.

8. A method of forming an electro-conductive pattern, the method comprising:

a. providing a liquid developer including;

i. core-shell particles containing a core portion selected from the group comprising copper and silver, and a shell portion selected from the group comprising copper and silver, wherein the shell portion is different from the core portion;

ii. a charge control agent; and iii. a liquid dispersion agent;

b. providing a pattern forming apparatus comprising;

i. an image holding body; and ii. a developer device including a development means, a squeeze means, and a liquid developer;

c. providing a media having dielectric properties;

d. developing conductive toner particles on a latent image onto said image holding body;

e. transferring said conductive toner particles to said media; and f. sintering conductive toner particles sufficient to consolidate at least a portion of electro-conductive particles.

* * * * *